United States Patent [19]

Geisselbrecht

[11] 3,977,676

[45] Aug. 31, 1976

[54] PORTABLE FRICTION TYPE EXERCISING APPARATUS

[76] Inventor: Werner Geisselbrecht, Spinozastrasse 6, 3000 Hannover, Germany

[22] Filed: May 19, 1975

[21] Appl. No.: 578,841

[30] Foreign Application Priority Data

May 22, 1974 Germany ..... 24249658

[52] U.S. Cl. ..... 272/131; 272/140

[51] Int. Cl.[2] ..... A63B 21/02

[58] Field of Search ..... 272/79 R, 80, DIG. 3, 272/DIG. 4, DIG. 5, 79 D, 83 A, 131, 140, 132, 133

[56] References Cited

UNITED STATES PATENTS 3,544,105 12/1970 Latta ..... 272/83 A

*Primary Examiner*—Richard C. Pinkham
*Assistant Examiner*—William R. Browne
*Attorney, Agent, or Firm*—Allison C. Collard

[57] ABSTRACT

A portable body building apparatus of the type comprising a casing having a spool of tape or the like which is drawn from the spool against a resistive force in performing exercises with the apparatus. In the apparatus the resistive force is provided by brake elements which frictionally engage the tape, which is in the form of a steel band. A plurality of push buttons select the number of brake elements in contact with the tape and thus determine the force of resistance experienced during the exercise.

14 Claims, 4 Drawing Figures

PORTABLE FRICTION TYPE EXERCISING APPARATUS

BACKGROUND OF THE INVENTION

The present invention relates to body building exercise apparatus and in particular to exercise apparatus of the portable type. Various forms of exercise apparatus are known; the portable type usually provides for pulling and pressing exercises in which work is done in extending or compressing a spring. Also known are devices in which an elongate element is unwound from a spool in performing the exercise, the resistance to movement being applied by a system of springs or by the inertia of a flywheel associated with the spool.

The prior art devices have one problem in common, however, that is that they do not allow long stretching movements. The tension applied in pulling exercise apparatus is mostly determined by the extension of springs where the tension increases towards the end of the movement. Although portable apparatus is known, this has the added disadvantage of being housed in a cumbersome and heavy casing. Adjustment of the power of resistance of such apparatus has up until now been both unsatisfactory and inaccurate. Moreover, in apparatus of the type having an elongate drawing element on a spool, wear on the drawing elements has until now been unavoidable. The most common cause of wear on the drawing element is friction, which creates heat which in many cases cannot be properly conducted away. Another cause of eventual failure of the drawing elements on the inertia reel type of apparatus is the rapid reversal from winding off action to winding on action, and the jerk which occurs when it is fully wound on if the energy in the inertia reel has not all been dissipated before then.

OBJECTS OF THE INVENTION

One object of the present invention is to provide a portable body building exercise apparatus with an elongate drawing element on a spool, which allows long stretching movements.

Another object of the present invention is to provide a portable body building exercise apparatus of the above type in which the resistive force is adjustable.

A further object of the invention is to provide a portable body building exercise apparatus of the above type in which the force of resistance does not vary in dependence on the degree of uncoiling from the spool as do spring resistance devices.

SUMMARY OF THE INVENTION

According to the present invention a portable body building exercise apparatus of the type comprising an elongate element on a spool from which it is drawn in performing the exercise, is characterised in that the spool is resiliently biased by a return spring and is mounted in a housing having a plurality of braking elements individually and selectively movable between a first position spaced from the elongate element and a second position in contact with the elongate element, the number of brake elements in contact with the elongate element determining the resistance to uncoiling from the spool.

Embodiments of the present invention can be made much lighter in weight and of smaller size than previously known apparatus of this general type. Preferably the casing housing the spool is of such a size that it can conveniently be fitted into the palm of a hand. Similarly, it is preferred that the brake elements comprise strips of an abrasion resistant resilient material which are inclined with respect to the line of movement of the elongate element such that movement of the elongate element as it is drawn from the spool increases the frictional resistance applied by the brake elements.

In the preferred embodiment the elongate element is a steel band. This steel band may be arcuately curved in cross section and is preferably curved towards the brake elements. There is preferably also provided a slide platform against which the elongate element is pressed by the brake elements in use of the apparatus. The slide platform also serves as a guide for the elongate element.

Preferably the resilient strips forming the brake elements are fixedly mounted at one end thereof remote from the elongate element and displaceable by flexing into their second position in which the other end thereof engages the elongate element, this flexing being increased by frictional engagement of the brake element with the elongate element as the latter is drawn from the spool, there being provided a plurality of abutments which are connected to the casing, which limit the flexing of the brake elements as the elongate element is drawn from the spool. Similarly it is preferred that the abutments are so positioned that they prevent the said other ends of the brake elements from reaching a position perpendicular to the elongate element during braking.

The braking elements exert the maximum frictional resistance to the movement of the elongate element when they are moved into engagement with these abutments. When the elongate element stops moving, the braking elements, due to their resilience, spring back into their original position where they merely engage lightly against the elongate element.

In the preferred embodiment the casing is formed of two half shells each having cylindrical bosses by means of which the two casing halves are secured together. The bosses may be screwed together or joined together by adhesive. For this latter purpose the bosses on one of the casing halves are hollow so that an adhesive can be inserted after assembly. Cooperating bosses may abut one another at their ends, or one may be made smaller than the other such that it fits therein.

In the preferred embodiment the flexing of the resilient strips forming the brake elements is effected by means of associated push-buttons which are depresssed to move the associated brake elements to their second positions, the push buttons having resilient tongues with catches for engagement with a part of the casing serving as a detent to latch the push button in one of its two positions. These push buttons may be generally U-shape, the sides of the arms thereof being ribbed to assist engagement with the fingers to pull the buttons out from their depressed positions. The U-shape form is also preferred since the arms can fit over the two casing parts and assist in holding these together. The casing parts are also partly held together by a foil covering carrying marking with information concerning the use of the apparatus.

The slide platform of the preferred embodiment is formed of two halves, each half being formed as part of the corresponding casing part.

It is possible to arrange a second steel band in a side by side arrangement inside the casing with an opposite pulling direction to that of the first band. With a corresponding number of brake elements, which could be arranged analogously to the first set of brake elements, the frictional force required to draw out both bands at once is effectively doubled.

It is quite possible to house a steel band of up to 3 m (10 ft) in length inside the spool and this enables long stretching movements to simulate different types of sport. The resisting force remains constant from the beginning to the end of the movement. The required frictional force can quickly and accurately be selected by pressing a selected number of push-buttons. The length of the steel band allows true partner training, i.e. the appliance can be used by two persons simultaneously. Because the complete appliance is only the size of the palm of a hand and is very light in weight, it can easily be carried in a pocket. The heat created by fiction is conducted to the outside by the steel band. This eliminates the premature wear through overheating on the brake elements, as the maximum temperature could reach 50°C. Because of the rounded edges of the steel band, personal injuries and damages to the casing or the guide elements are avoided.

Various other features and advantages of the invention will become apparent from the following description with reference to the accompanying drawings, which is provided purely by way of non-restrictive example.

DESCRIPTION OF PREFERRED EMBODIMENTS

Figure 1:
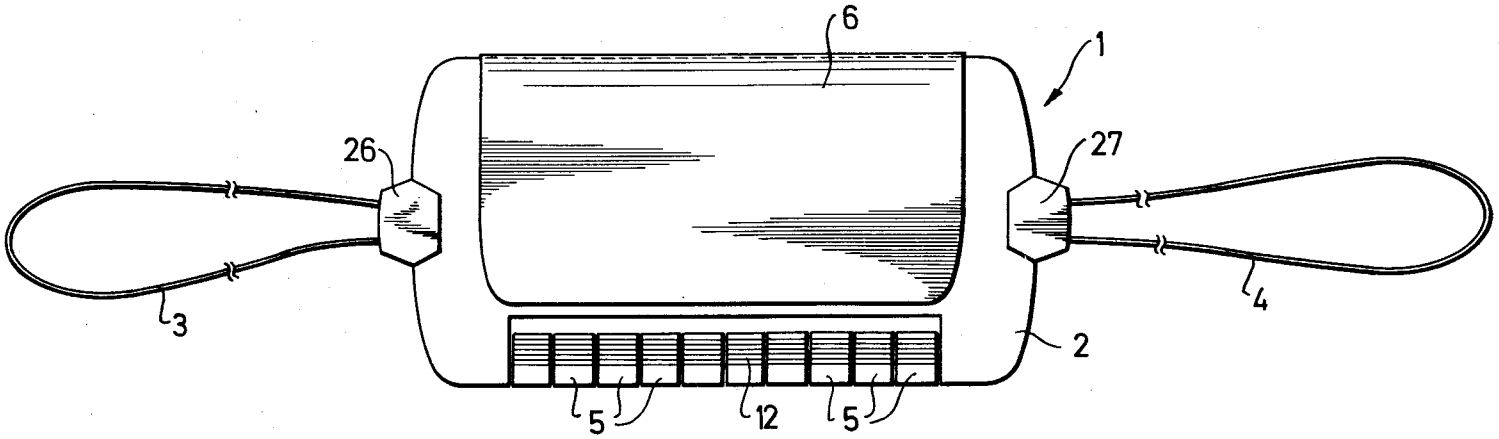
FIG. 1 is a plan view of the embodiment.
Figure 2:
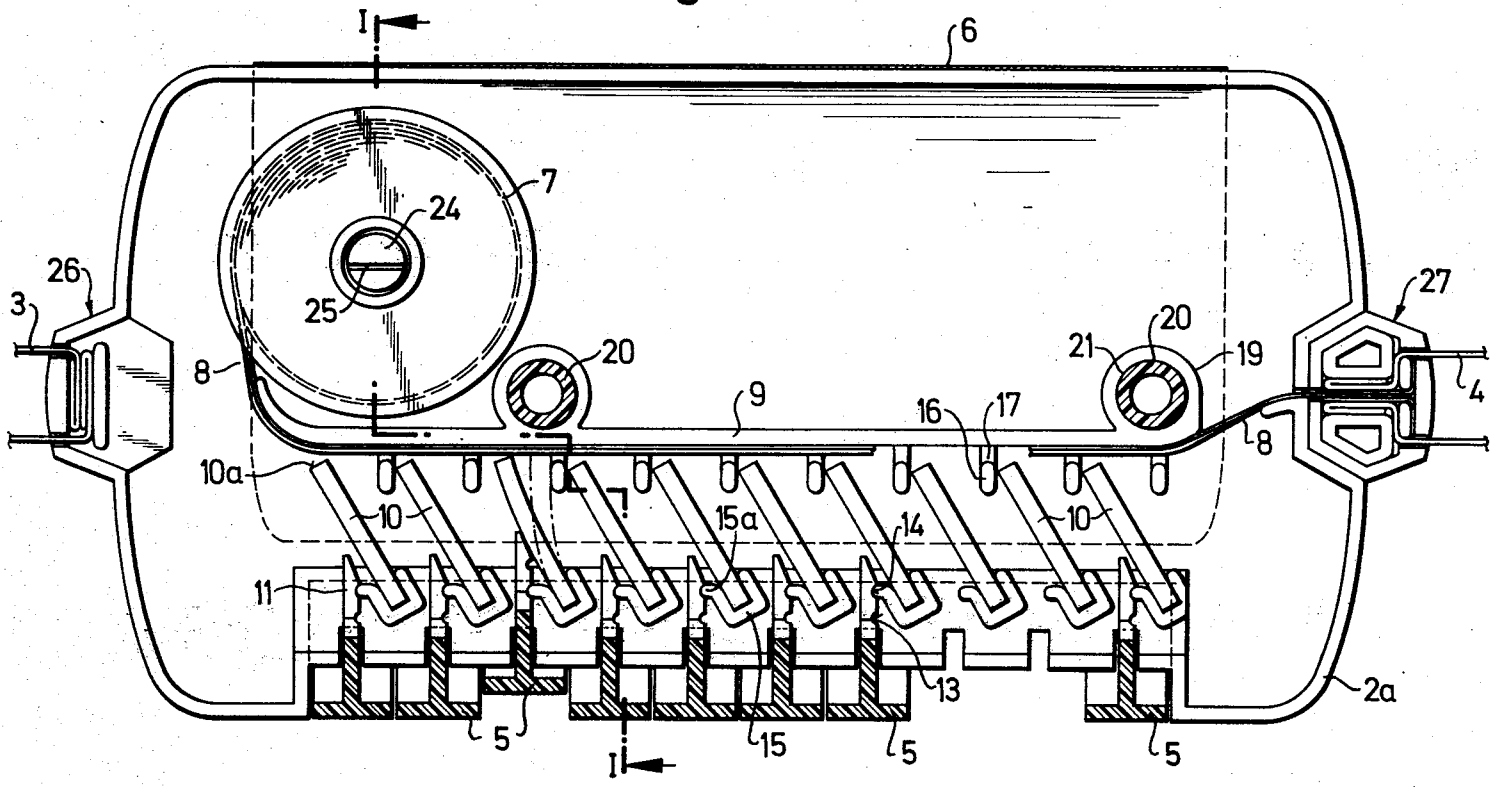
FIG. 2 is a view of the embodiment with the casing cover removed.

Referring now to the drawings, the embodiment shown is a body building exercise apparatus 1 comprising a housing 2 within which is located a spool 7 carrying an elongate element 8 in the form of a steel band which, in use of the apparatus is drawn from the spool against frictional resistance created by a plurality of resilient brake elements 10 each of which can be engaged with the steel band 8 by depressing an associated push button 5. The frictional resistance, and thus the force required to draw the steel band 8 from the spool 7 can be increased by depressing more push buttons, and decreased by releasing some of those which are depressed.

The housing 2 consists of a casing which is roughly the size of the palm of a hand and is provided with two gripping loops 3 and 4. The trip loop 3 is fastened to one end of the casing 2, and the grip loop 4 is formed by the free end of the elongate element 8 which is drawn from the casing 2 in use of the apparatus. The casing 2 is formed in two halves **2*a*, 2*b*, held together in part by two sets of hollow bosses 19, 20 which fit into each other and are secured by adhesive. The inner boss 20 is open at both ends so that adhesive can be introduced into it after assembly, the adhesive working its way up the common interface 21 between the cylinders by capillary action. Connection of the two halves 2*a*, 2*b* of the casing is also enhanced by a metal foil 6** wrapped over the joint along one edge of the casing and secured in place by adhesive. The metal foil carries information of use to a person using the apparatus.

The spool 7 is mounted on a spindle 24 projecting from the casing half **2*a* (that is the lower casing half as viewed in FIG. 3), and between the spool 7 and the spindle 24 is a light return spring (not shown) the end of which is engaged in a notch 25 in the spindle 24. The upper casing half 2*b* has a short boss 23 which completes the mounting spindle for the spool 7, being aligned with the spindle 24.**

Figure 3:
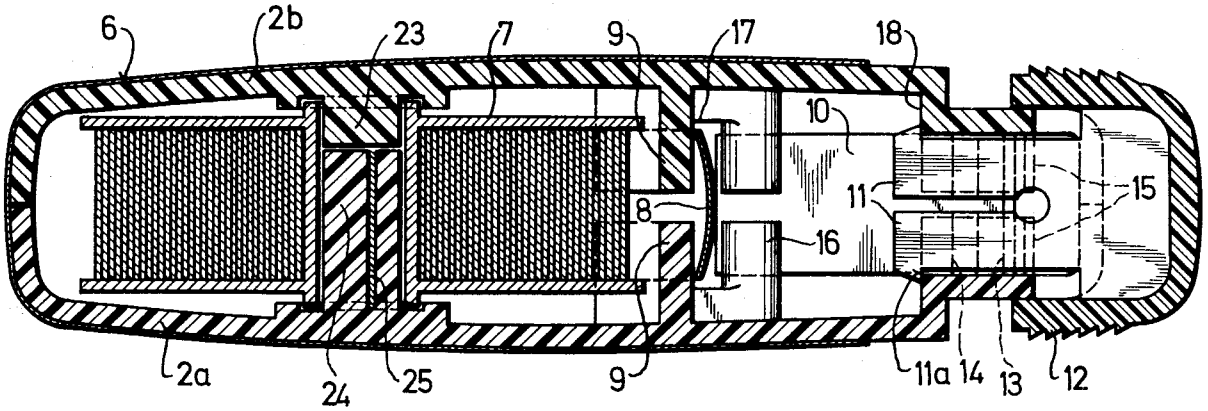
FIG. 3 is a cross section on the line III—III of FIG. 2.
Figure 4:
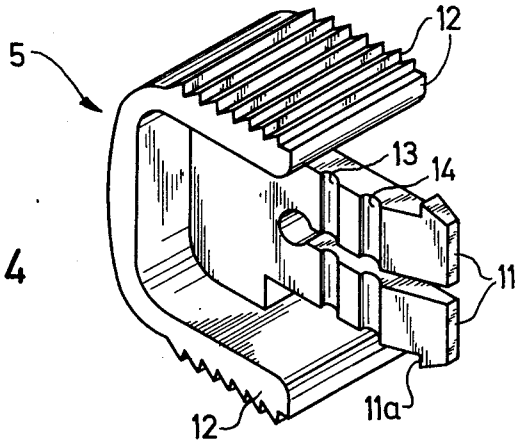
FIG. 4 is a perspective view of one push button of the embodiment shown in FIGS. 1 to 3.

The steel band 8, as it is drawn from the spool 7, passes between the array of brake elements 10 and a slide platform 9 which serves in part as a guide for the band 8 and in part as a pressure plate against which the band is pressed by those of the brake element 10 which are engaged with the band 8. The brake elements 10 themselves comprise strips of a resilient abrasion resistant material mounted in respective mounting supports 15 and are inclined towards the steel band 9 such that their free ends are spaced slightly therefrom when undeflected. The brake elements 10 can be deflected so that their free ends engage the steel band 9 by depression of a respective associated push button 5. The push buttons 5 are arranged in an array along one side of the casing 2. With reference to FIG. 4 it will be seen that each push button 5 comprises a generally U-shape body having parallel arms 12 with ridged finger grips on the outside of each. From the base, and extending between the arms 12 is a bifurcated resilient clip 11 each arm of which has a lateral tooth **11*a* and two transverse grooves 13, 14. As will be seen from FIG. 3 the two arms 12 of each push button, embrace the two halves 2*a*, 2*b* of the casing 2, which are stepped in this region to provide two parallel slide surfaces for the push button arms 12 to engage. This step in the casing halves 2*a*, 2*b* also forms a shoulder 18 against which the teeth 11*a* of the resilient clip 11 engage to resist removal of the push button 5 from the casing. It will be appreciated that the push button arms 12 assist in holding the two casing halves 2*a*, 2*b*** together.

When a push button 5 is in its normal, outer, position, the groove 14 engages over a projection **15*a* of the associated brake element mounting support 15; upon depression of a push button the resilient clip 11 moves inwards until the groove 13 engages over the projection 15*a* to hold the push button in the depressed position. In this depressed position of the push button 5 the end of the resilient clip 11 engages the associated brake element 10 and deflects this into engagement with the steel band 9. As the band is drawn from the spool 7 it frictionally engages the brake elements which are deflected by those of the push buttons 5 which are depressed, and deflects these further until they come into engagement with an associated abutment 16 which prevents further deflection. The abutments 16 are carried on lateral flanges 17, and are integrally formed with the casing halves, the flanges 17 forming guides for the steel band 8 which, as can be seen in FIG. 3 is curved in cross section, convex towards the brake elements, such that it engages the slide platform 9 only at its edges. The slide platform itself is formed in two longitudinally separated halves each integral with an associated casing half 2*a*, 2*b*.**

By pulling the gripping loops 3 and 4, the steel band 8 is drawn from the spool 7 and this movement is resisted by those of the brake elements in engagement therewith, which are deflected into engagement with the abutments 16, which latter prevent the brake elements from passing a position in which the contacting end is perpendicular to the steel band 8 since if this occurred the braking effect would be reduced: in the position reached the braking effect is the maximum obtainable. Moreover, by thus limiting the deflection of the brake elements 10, the abutments 16 ensure that these can return to their original positions, lightly engaging the steel band 8 when movement thereof has stopped. This light engagement ensures that the steel band, even with engaged push-buttons, can be pulled back by the force of the return spring (not illustrated) of the spool 7 because, due to the curvature of the steel band, which is convex towards the brake elements, there is only a point contact between these two parts.

I claim:

1. A portable body building exercise apparatus of the type comprising:

a spool and an elongate elment wound on said spool, casing means housing said spool, fixed gripping means fixed on said casing means movable gripping means connected at the free end of sail elongate element, whereby a user can grasp said casing means by means of said fixed gripping means and the free end of said elongate element by means of said movable gripping means to draw said elongate element off said spool in performing body building exercises, resisting means for resisting the withdrawal of said elongate element from said spool, said resisting means comprising a plurality of brake elements mounted on said casing means, and each being movable between a first position spaced from said elongate element and a second position in contact with said elongate element, and means for selectively moving said individual brake elements between said first and second positions thereof whereby to determine the number of brake elements in contact with said elongate element and thus the resistance to withdrawal of said elongate element from said spool.

2. Apparatus as in claim 1, wherein said brake elements include strips of an abrasion resistant resilient material, said strips being mounted on said casing means so as to be inclined with respect to the line of movement of said elongate element towards said spool, whereby movement of said elongate element as it is drawn from said spool increases the frictional resistance applied by those of said brake elements in contact therewith.

3. Apparatus as in claim 2, wherein the resilient strips forming said brake elements are fixedly mounted at one end thereof remote from said elongate element and displaceable by flexing into their second position in which the other end thereof engages said elongate element, this flexing being increased by frictional engagement of said brake element with said elongate element as the latter is drawn from the spool, there being provided a plurality of abutments connected to said casing means, said abutments limiting the flexing of said brake elements which occurs as said elongate element is drawn from the spool.

4. Apparatus as in claim 3, wherein said abutments are so positioned that they prevent said other ends of said brake elements from reaching a position where they are perpendicular to said elongate element during braking.

5. Apparatus as in claim 6 wherein said elongated element is a steel band, the edges of said steel band being rounded off, and there are lateral guide means on each of said casing means half sheels for guiding said steel band in said casing means, said lateral guide means comprising flange elements joining said abutments.

6. Apparatus as in claim 1, wherein said elongate element is a steel band which is curved in cross section.

7. Apparatus as in claim 1, wherein said brake elements are mounted in a row in said casing means, and said casing means has an elongate slide platform therein extending parallel to said row of brake elements, said elongate element passing between said slide platform and said row of brake elements and being pressed against said slide platform by those of said brake elements in said second, contacting, position thereof.

8. Apparatus as in claim 7, wherein said slide platform is formed of two halves, each half being formed as part of the corresponding casing half shell.

9. Apparatus as in claim 1, wherein said casing means is formed of two half shells each said half shell having cylindrical bosses which interengage when said two half shells are fitted together.

10. Apparatus as in claim 9, wherein there is an adhesive foil covering casing means, on the side thereof opposite said push-buttons, said adhesive foil being covered with indicia to serve as an information guide.

11. Apparatus as in claim 1, wherein said means for selectively moving said brake elements between said first and second positions comprises a plurality of push-buttons, one for each said brake element, said push buttons being depressed to move the associated brake element to its second position and released to allow said associated brake element to return to its first position.

12. Apparatus as in claim 11 wherein each said push button has resilient tongues with laterally projecting teeth, and said casing means has a shoulder engageable by said teeth of said resilient tongues of said push buttons.

13. Apparatus as in claim 11, wherein said push buttons are generally U-shaped elements having a pair of arms, the outer sides of said arms being ribbed to assist engagement by a user's fingers to pull the buttons out from their depressed positions.

14. Apparatus as in claim 13, wherein said arms of said U-shaped push buttons embrace said two half-shells of said casing means and assist in holding these together.

* * * * *